United States Patent [19]

Erickson

[11] 4,020,212

[45] Apr. 26, 1977

[54] POLYOLEFIN FIBERS USEFUL AS FIBERFILL TREATED WITH FINISHING AGENT COMPRISING AN ORGANOPOLYSILOXANE AND A SURFACE ACTIVE SOFTENER

[75] Inventor: Wayne K. Erickson, Greenville, S.C.

[73] Assignee: Phillips Petroleum Company, Bartlesville, Okla.

[22] Filed: Apr. 21, 1976

[21] Appl. No.: 679,122

Related U.S. Application Data

[62] Division of Ser. No. 505,916, Sept. 13, 1974, Pat. No. 3,968,042.

[52] U.S. Cl. ..... 428/361; 5/361 R; 428/362; 428/391

[51] Int. Cl.[2] ..... A47C 27/00; D06M 13/18; D06M 13/46

[58] Field of Search ..... 428/361, 362, 391; 252/8.8, 8.9; 5/361 R

[56] References Cited

UNITED STATES PATENTS

| | | | |
|---|---|---|---|
| 3,619,278 | 11/1971 | Ogawa | 427/381 |
| 3,653,955 | 4/1972 | Habib | 427/214 |
| 3,968,042 | 7/1976 | Erickson | 428/391 |
| R27,587 | 2/1973 | Paligenka et al. | 260/824 R |

*Primary Examiner*—J.C. Cannon

[57] ABSTRACT

A finishing agent is provided comprising an organopolysiloxane, a surface-active material having softening properties for polyolefin fibers, a nonionic wetting agent, a buffering agent, and a corrosion inhibitor. A nonscroopy polyolefin fiber is provided.

10 Claims, No Drawings

POLYOLEFIN FIBERS USEFUL AS FIBERFILL TREATED WITH FINISHING AGENT COMPRISING AN ORGANOPOLYSILOXANE AND A SURFACE ACTIVE SOFTENER

This application is a division of copending application Ser. No. 505,916 filed Sept. 13, 1974, and now U.S. Pat. No. 3,968,042.

BACKGROUND OF THE INVENTION

The invention relates to a finishing agent composition and to a nonscroopy polyolefin fiber. In another aspect the invention relates to nonscroopy polyolefin fiberfill.

In recent years the material utilized for fiberfill, such as pillow stuffing has changed from predominantly natural materials to predominantly synthetic fibers. The synthetic fibers have the advantages of being more uniform, substantially free of odor, substantially nonallergenic, and readily washable. However, difficulty has been encountered in the utilization of these synthetic fibers for fiberfill, primarily due to a condition called scroop. Scroop is a condition which occurs as the fibers move during compression, and a stick-slip or jerking type of fiber-to-fiber frictional response is heard or felt, leaving the impression of harshness or crispness. In products such as pillows, this type of response is completely unacceptable.

Several finishing agents have been developed to prevent the above difficulties associated with the use of synthetic fiberfill; however, in most instances solution of one problem merely generates another. For example, some finishing agents produce fiberfill with very little scroop, but these finishing agents increase the price of the fiberfill substantially. Other finish agents have been developed which are economical in themselves, but which are corrosive in nature and require the use of corrosive-resistant materials for processing equipment, thus increasing the overall cost of the product. Still other finishing agents are unsatisfactory because they foam, reducing the amount of finish which can be applied to the fiber below that amount necessary to produce a satisfactory product. Still other finishing agents leave deposits on equipment which build up over a relatively short period of time to a level which necessitates shutting down the process to clean the equipment. These and other disadvantages of the prior art to overcome by the present invention.

Accordingly it is an object of the present invention to provide a finishing agent for polyolefin fibers.

Another object of the invention is to provide a finishing agent useful to produce nonscroopy polyolefin fiberfill.

Still another object of the invention is to provide a new and improved nonscroopy polyolefin fiber.

Still another object of the invention is to provide a new and improved nonscroopy polyolefin fiberfill.

Other objects, advantages and aspects of the present invention will be apparent to those skilled in the art after studying the specification and the appended claims.

SUMMARY OF THE INVENTION

According to the invention, there is provided a two-component finishing agent comprising: on a dry solids basis, from about 60 to about 80 weight percent of a first component and from about 20 to about 40 weight percent of a second component wherein said first component comprises an organopolysiloxane and said second component comprises from about 86 to about 98 weight percent of a surface-active material having softening properties for polyolefin fibers; from about 0.3 to about 2 weight percent of a nonionic wetting agent; from about 0.7 to about 4 weight percent of a buffering agent; and from about 1 to about 8 weight percent of a corrosion inhibitor; with the amounts of said components being adjusted within said ranges relative to each other so that when said composition is dispersed in water to provide an aqueous dispersion containing from about 1 to about 20 weight percent solids, said dispersion has a pH within the range of from 6 to 8.

Further according to the invention, there is provided a product comprising polyolefin fibers having deposited thereon a thin coating of a small but effective amount, sufficient to reduce the scroopiness of said fibers, of the finishing agent described above. The fibers thus coated with the finish of the present invention can be crimped and cut into staple as known in the art to produce a new and useful non-scroopy polyolefin fiberfill.

DETAILED DESCRIPTION OF THE INVENTION

The organopolysiloxanes which are useful in the present invention vary widely. Generally they include those compounds having the formula

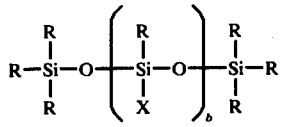

wherein each R is individually selected from the group consisting of alkyls having from 1 to 6 carbon atoms, each X is individually selected from the group consisting of R and $(CH_2CH_2O)_cH$ with from 10 to 90 percent of the X's being R, *b* being an integer having a value of at least 10 and *c* is an integer having a value of at least 20. In a presently preferred embodiment, each R is methyl, *b* is in the range of 10 to 22, *c* is in the range of 20 to 40, and the percent of the X's being methyl is in the range of about 60% to about 80%. The silicon content of the organopolysiloxane will generally be in the range of about 10 to about 60 weight percent, and preferably will be about 20 weight percent of the total polymer. The organopolysiloxane is water-dispersible, has a viscosity in the range of about 100 to about 400, preferably in the range of about 150 to about 350 centistokes at 77° F, and has a specific gravity in the range of about 1.01 to about 1.05 at 77° F.

A number of surface-active materials having softening properties for polyolefin fabrics are useful in the present invention. Such materials are commonly quaternary ammonium salts. One group of such materials can be represented by the formula

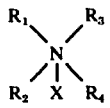

wherein: $R_1$ and $R_2$ are alkyl radicals containing from about 14 to 20 carbon atoms; $R_3$ is a methyl radical; $R_4$ is a methyl, ethyl, or the ethoxylated radical $(CH_2—CH_2O)_nH$ where *n* is an integer of at least one;

and X is a chlorine, bromine, sulfate, methosulfate, or ethosulfate anion.

The quarternary ammonium salts which are presently preferred for use in the practice of the invention include the compounds represented by the above formula, distearyl dimethyl ammonium chloride (Varisoft 100 — a tradename), stearyl dimethyl benzyl ammonium chloride (Varisoft SDC — a tradename), 1-methyl-1-alkylamidoethyl-2-alkyl imidazolinium methosulfate (Varisoft 475 — a tradename); and Varisoft 222 — a tradename, a complex difatty quaternary compound. Excellent results have been obtained when using distearyl dimethyl ammonium chloride, and this compound is presently the more preferred material for use in the practice of the invention, particularly when producing polypropylene fiberfill product.

A number of the above-described surface-active materials have the disadvantage of sometimes being corrosive to some processing machinery. It has been discovered that this disadvantage can be overcome, without the expense of employing corrosion-resistant machinery, by the use of a two-component finishing agent comprising: on a dry solids basis, from about 60 to about 80 weight percent of a first component and from about 20 to about 40 weight percent of a second component wherein said first component comprises an organopolysiloxane and said second component comprises from about 86 to about 98 weight percent of a surface-active material having softening properties for polyolefin fibers; from about 0.3 to about 2 weight percent of a nonionic wetting agent; from about 0.7 to about 4 weight percent of a buffering agent; and from about 1 to about 8 weight percent of a corrosion inhibitor; with the amounts of said components being adjusted within said ranges relative to each other so that when said composition is dispersed in water to provide an aqueous dispersion containing from about 1 to about 20 weight percent solids, said dispersion has a pH within the range of from 6 to 8.

A two-component finishing agent comprising from about 65 to about 75 weight percent of said first component and from about 25 to 35 weight percent of said second component also can be used; however, good results are obtained employing a two-component finishing agent comprising from about 69 to about 71 weight percent of said first component and from about 29 to about 31 weight percent of said second component.

Any of the above-disclosed organopolysiloxane materials and surface-active materials having softening properties for polyolefin fibers; any suitable known nonionic wetting agent; any suitable known buffering agent; and any suitable known corrosion inhibitor can be used in preparing said finishing agent composition. A presently preferred composition is obtained when: in addition to the previously described, presently preferred organopolysiloxane, said surface-active material having softening properties is distearyl dimethyl ammonium chloride; said nonionic wetting agent is a capped polyethoxylated straight chain alcohol; said buffering agent is sodium borate decahydrate; said corrosion inhibitor is sodium nitrite; and said aqueous dispersion contains from about 5 to about 10 weight percent solids.

The finishing agent of the present invention is preferably applied to the fiber in the form of an aqueous dispersion to form a thin coating thereon, in a small but effective amount, sufficient to reduce the scroopiness of the fibers. Generally the thin coating is a deposit on the fibers of from about 0.1 to about 1.0 weight percent of finish solids, based on the weight of the fibers.

The fibers of the present invention are polyolefins such as polyethylene, polypropylene, and copolymers of ethylene or propylene. The spinning of such fibers and subsequent drawing, crimping, cutting into staple, etc., are well known in the art and are not part of the invention herein.

Generally the fibers are treated with the finishing agent subsequent to spinning, but the treatment can be accomplished at other times, such as prior to crimping.

Also the finishing agent is usually applied to the fibers using kiss rolls which are well known; however other methods of application can be used such as spraying the fibers or bathing the fibers in the finish.

The fibers of the present invention are particularly well suited for use as fiberfill after being crimped and cut into staple, etc., especially where polypropylene is used as the polyolefin. Polypropylene staple produced employing the present invention has excellent scroop characteristics and is economical to produce.

It was surprising and unexpected that the finish composition of the present invention could be used to produce nonscroopy polyolefin fibers because organopolysiloxanes when used as a finish produce very scroopy polyolefin fibers. It should be pointed out, however, that it was known that nonscroopy polypropylene fibers could be produced employing a finish comprising only a quaternary ammonium salt, a nonionic wetting agent, a buffering agent and a corrosion inhibitor, but such a finish was unsatisfactory because it foamed and left deposits on processing equipment. It was thus surprising and unexpected that the finish composition of the present invention, which contains 60 to 80 percent of a known "scroop producing" finishing agent, would produce a nonscroopy product, and further that the problems of foaming and finish buildup on equipment could be eliminated at the same time.

EXAMPLE

As evidence of the outstanding results produced by employing the finishing agent of the present invention, the following example is provided.

Polypropylene fiberfill was produced employing a finishing agent composition comprising only the second component of the present invention, a known finishing agent useful to produce nonscroopy fiberfill. The finishing agent consisted of 93.9 weight percent distearyl dimethyl ammonium chloride; 1.0 weight percent of a capped polyethoxylated straight-chain alcohol; 1.0 weight percent sodium borate decahydrate; and 4.1 weight percent sodium nitrite. The maximum amount of polypropylene fiberfill produced was approximately 50,000 pounds per week.

Employing the same process and equipment as above, but changing the finish to that of the present invention, a substantial increase in productivity was realized. The finishing agent consisted of 70 weight percent organopolysiloxane and 30 weight percent of the finishing agent used above. The increase in production of the polypropylene fiberfill was approximately 30 percent. In both instances the polypropylene fiberfill produced was nonscroopy and satisfactory for use as filling for pillows. The substantial increase in production achieved by using the finish of the present invention is attributed to the excellent lubricity and the very good antifoaming characteristics of the finish.

What is claimed is:

1. A product comprising polyolefin fiber having deposited thereon a thin coating of a small but effective amount, sufficient to reduce the scroopiness of said fibers, of a finishing agent composition comprising:

on a dry solids basis, from about 60 to about 80 weight percent of a first component and from about 20 to about 40 weight percent of a second component wherein said first component comprises an organopolysiloxane represented by the formula

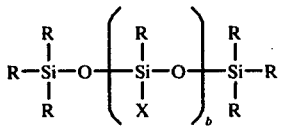

wherein each R is individually selected from the group consisting of alkyls having from 1 to 6 carbon atoms, each X is individually selected from the group consisting of R and $(—CH_2CH_2O—)_cH$ with from 10 to 20% of the X's being R, *b* is an integer having a value of at least 10, and *c* is an integer having a value of at least 20 and said second component comprises from about 86 to about 98 weight percent of a quaternary ammonium salt surface-active material having softening properties for polyolefin fibers; from about 0.3 to about 2 weight percent of a nonionic wetting agent; from about 0.7 to about 4 weight percent of a buffering agent; and from about 1 to about 8 weight percent of a corrosion inhibitor; with the amounts of said components being adjusted within said ranges relative to each other so that when said composition is dispersed in water to provide an aqueous dispersion containing from about 1 to about 20 weight percent solids, said dispersion has a pH within the range of from 6 to 8.

2. The product of claim 1 wherein the surface-active material having softening properties of polyolefin fibers is a quaternary ammonium salt represented by the formula

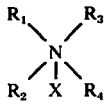

wherein $R_1$ and $R_2$ are alkyl radicals containing from about 14 to 20 carbon atoms; $R_3$ is a methyl radical; $R_4$ is a methyl, ethyl, or the ethoxylated radical $(CH_2—CH_2O)_nH$ wherein *n* is an integer of at least 1; and X is a chlorine, bromine, sulfate, methosulfate, or ethosulfate anion.

3. The product of claim 2 wherein the quaternary ammonium salt is selected from the group consisting of distearyl dimethyl ammonium chloride, stearyl dimethyl benzyl ammonium chloride, and 1-methyl-1-alkylamidoethyl-2-alkylimidazolinium methylsulfate.

4. The product of claim 1 wherein the formula for the organopolysiloxane each R is methyl, *b* is in the range of 10 to 22, *c* is in the range of 20 to 40, the percent of the X's being methyl is in the range of about 60 percent to about 80 percent, and the silicon content is in the range of about 10 to about 60 weight percent.

5. The product of claim 4 wherein the polyolefin is polypropylene, the surface-active material having softening properties for the polypropylene fibers is distearyl dimethyl chloride, the nonionic wetting agent is a capped polyethoxylated straight-chain alcohol, the buffering agent is sodium borate decahydrate, the corrosion inhibitor is sodium nitrite, and the aqueous dispersion contains from 5 to about 10 weight percent solids.

6. The product of claim 1 wherein the first component comprises from about 65 to about 75 weight percent of the finish and the second component comprises from about 25 to about 35 weight percent of the finish.

7. The product of claim 6 wherein the first component comprises from about 69 to about 71 weight percent of the finish and the second component comprises from about 29 to about 31 weight percent of the finish.

8. The product of claim 1 wherein the amount of said finishing agent deposited on said fiber ranges from about 0.1 to about 1 weight percent based on the weight of said fibers.

9. The product of claim 8 wherein the fibers are crimped and cut into staple to produce a material useful for fiberfill.

10. The product of claim 9 wherein the polyolefin is polypropylene.

* * * * *

UNITED STATES PATENT AND TRADEMARK OFFICE

CERTIFICATE OF CORRECTION

PATENT NO. : 4,020,212

DATED : April 26, 1977

INVENTOR(S) : Wayne K. Erickson

It is certified that error appears in the above-identified patent and that said Letters Patent are hereby corrected as shown below:

Column 5, line 2, for "fiber" read --- fibers ---; Column 6, line 12, after "wherein" read --- in ---; line 22, after "dimethyl" read --- ammonium ---; line 39, for "fiber" read --- fibers ---.

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademark*